United States Patent [19]

Matejec

[11] Patent Number: 4,830,954

[45] Date of Patent: May 16, 1989

[54] COLOR PHOTOGRAPHIC NEGATIVE FILM

[75] Inventor: Reinhart Matejec, Leverkusen, Fed. Rep. of Germany

[73] Assignee: Agfa-Gevaert Aktiengesellschaft, Leverkusen, Fed. Rep. of Germany

[21] Appl. No.: 98,870

[22] Filed: Feb. 21, 1987

[30] Foreign Application Priority Data

Oct. 3, 1986 [DE] Fed. Rep. of Germany ..... 3633713

[51] Int. Cl.[4] ..... G03C 1/08; G03C 1/46; G03C 7/26; G03C 7/32

[52] U.S. Cl. ..... 430/505; 430/503; 430/506; 430/507; 430/509; 430/544; 430/549; 430/558; 430/957

[58] Field of Search ..... 430/503, 505, 506, 509, 430/544, 549, 507, 558, 957

[56] References Cited

U.S. PATENT DOCUMENTS

| | | | |
|---|---|---|---|
| 4,348,474 | 9/1982 | Scheeer et al. | 430/392 |
| 4,414,308 | 11/1983 | Hamada | 430/505 |
| 4,500,634 | 2/1985 | Sakanoue et al. | 430/544 |
| 4,725,529 | 2/1988 | Shimazaki et al. | 430/506 |
| 4,729,943 | 3/1988 | Pfaff et al. | 430/505 |
| 4,748,107 | 5/1988 | Umemoto et al. | 430/505 |

*Primary Examiner*—Mukund J. Shah
*Attorney, Agent, or Firm*—Connolly and Hutz

[57] ABSTRACT

The sensitivity of color photographic negative films may be increased without loss of color quality or sharpness by applying at least one panchromatically sensitized, highly sensitive and black-coupling layer as uppermost, additional light sensitive and dye-forming layer on the side of the film facing the object and including in the negative material sufficient DIR-Coupler to produce an interimage effect of ≧10% in the yellow region, ≧25% in the magenta region and ≧15% in the cyan region.

5 Claims, 2 Drawing Sheets

COLOR PHOTOGRAPHIC NEGATIVE FILM

This invention relates to a colour photographic negative film with improved sensitivity without decreasing colour quality.

It is known to produce highly sensitive colour photographic negative films by aranging the light sensitive emulsion layers which are sensitized to the blue, green and red spectral regions, respectively, as double or triple layers differing in their sensitivity. These layers are arranged in the conventional manner, i.e. the red sensitive layers are arranged nearest the support and are followed successively by the green sensitive layers, a yellow filter layer and the blue sensitive layers, or the layers may be arranged differently, e.g. they may be arranged alternately, with the most highly sensitive red sensitive layer situated between the green sensitive layers.

It is also known from DE-AS No. 1 547 707 to equip colour photographic negative material with a panchromatically sensitized silver halide emulsion layer which copies to a neutral grey, this layer being arranged above the colour sensitive layers and having a higher sensitivity than these colour sensitive layers.

Such a material increases the sensitivity of the negative material, albeit at the expense of the quality of the colour, especially when the film is underexposed.

It is an object of the present invention to improve the overall sensitivity of a colour photographic negative material by means of a panchromatically sensitized layer coupling to a neutral grey but at the same time to ensure by suitable measures that the colour quality is not impaired or at least only to a slight extent.

The problem is solved according to this invention by providing the negative material with sufficient DIR-coupler to produce an interimage effect (IIE) of ≧10% in the yellow region, ≧25% in the magenta region and ≧15% in the cyan region.

The present invention thus relates to a colour photographic negative film comprising at least one yellow coupling, blue sensitive silver halide emulsion layer, at least one magenta coupling, green sensitive silver halide emulsion layer, at least one cyan coupling red sensitive silver halide emulsion layer and at least one panchromatically sensitized, black coupling layer which is arranged as uppermost light sensitive layer and has a sensitivity greater by at least 3 DIN than the most highly sensitive of the blue, green and red sensitive layers, measured in each case as individual layer against white light, as well as other, conventional filter layers, separating layers, protective and auxillary layers, all mounted on a transparent support, characterised in that the negative film contains sufficient DIR-coupler to produce an IIE of ≧10% in the yellow, ≧25% in the magenta and ≧15% in the cyan region.

The IIE is measured (T. H. James, The Theory of the Photographic process, 4th Edition, McMillan Co. N.Y. (1977) Pages 574 and 614) as percentage increase in the colour gradation when colour separation exposure is carried out with light of the corresponding spectral region, compared with the colour gradation obtained on exposure to white light.

The panchromatically sensitized layer preferably does not contain DIR coupler.

If the photographic material contains several light sensitive colour layers for the same spectral region then the DIR coupler is preferably arranged in the less sensitive layers.

DIR coupler may in addition be present in the more highly sensitive colour layer but the coupling velocity of the DIR coupler in the more highly sensitive colour layer should be preferably less by a factor of 1.5–25 than of the dye-couplers of this layer.

DIR couplers may also be provided in separating layers, filter layers or other auxillary layers.

It is on the whole preferred to use DIR couplers whose inhibitors have diffusibility according to EP-OS No. 101 621 greater than 0.4.

Preferred DIR couplers correspond to the formula:

$$A-(X)_l-(Y)_m$$

wherein:

A denotes a coupler group,

X denotes an intermediate member, l denotes 0, 1 or 2, m denotes 1 or 2, and

Y denotes a group corresponding to one of the following formulae which can be split off by a colour developer oxidation product:

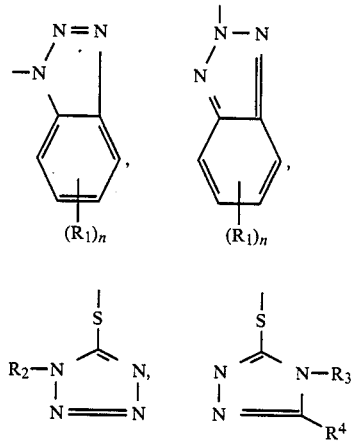

wherein:

$R_1$ denotes alkyl, alkoxy, acylamino, halogen, alkoxycarbonyl, thiazolidinylidene amino, aryloxycarbonyl, acyloxy, carbamoyl, N-alkylcarbamoyl, N,N-dialkylcarbamoy, nitro, amino, N-arylcarbamoyloxy, sulphamoyl, N-alkylcarbamoyloxy, hydroxy, alkoxycarbonyl amino, alkylthio, arylthio, aryl, cyano, alkylsulphonyl or aryloxycarbonylamino or a heterocyclic group, n has the value 1 or 2, $R_2$ denotes alkyl, aryl or a heterocyclic group, $R_3$ denotes hydrogen, alkyl, aryl or a heterocyclic group and $R_4$ denotes hydrogen, alkyl, aryl, halogen, acylamino, alkoxycarbonylamino, aryloxycarbonyl amino, alkylthio, amino or a heterocyclic group.

An alkyl group denoted by $R_1$ to $R_4$ may consist in particular of a substituted or unsubstituted, straight chained or branched or cyclic alkyl group and may contain halogen, nitro, cyano, aryl, alkoxy, aryloxy, alkoxycarbonyl, aryloxycarbonyl, sulphamoyl, carbamoyl, hydroxy, alkylsulphonyl, arylsulphony, alkylthio or arylthio as substituents.

An aryl group denoted by $R_1$ to $R_4$ may be in particular a phenyl group optionally substituted by alkyl, alkenyl, alkoxy, alkoxycarbonyl, halogen, nitro, amino, sulphamoyl, hydroxy, carbamoyl, aryloxycarbonyl amino, alkoxycarbonyl amino, acyl amino, cyano or ureido.

Heterocyclic groups denoted by $R_1$ to $R_4$ may in particular be 5- or 6-membered rings, optionally condensed, in particular benzo-condensed, and these may be aryl substituted. Examples of heterocyclic groups include the pyridyl, quinolyl, furyl, benzothiazolyl, oxazolyl, imidazolyl, thiazolyl, triazolyl, benzotriazolyl and oxazinyl groups.

If the group Y is attached to the coupling position of A through an intermediate member X, then the group —X—Y is first split off under the influence of the developer oxidation product and then releases the inhibitor group Y after a controlled delay. DIR couplers in which l has the value 0 are particularly preferred.

The following are specific examples of DIR couplers:

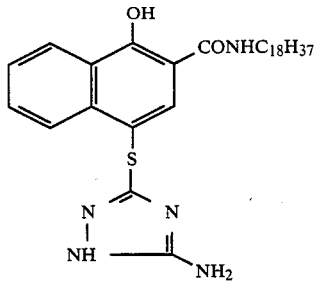

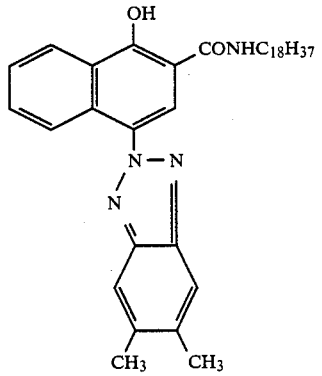

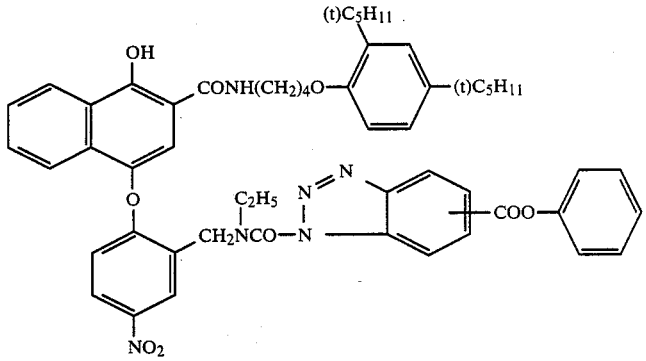

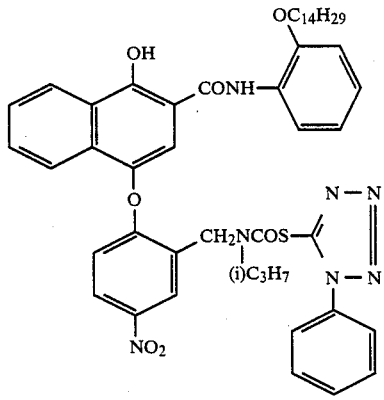

-continued
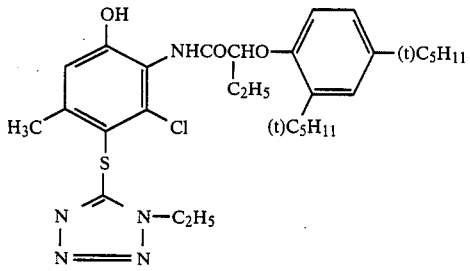
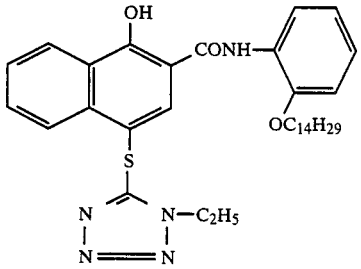
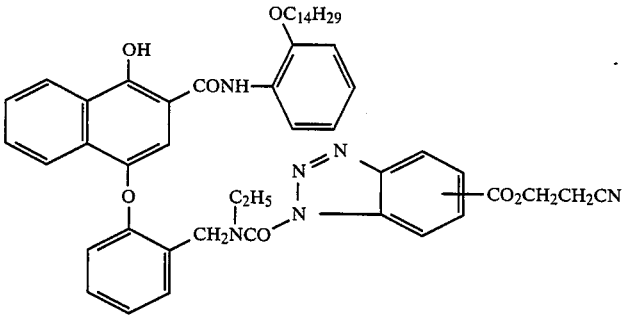
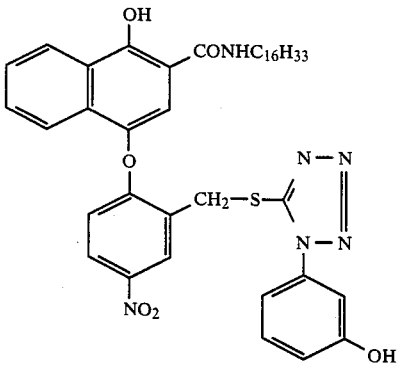
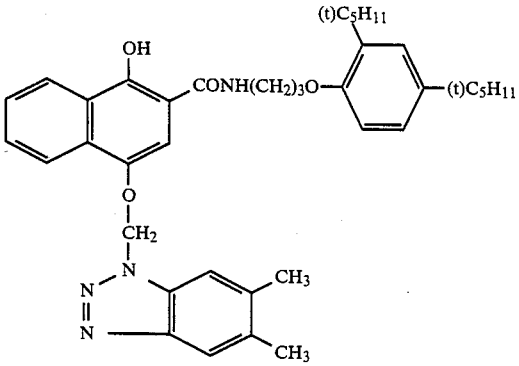

-continued
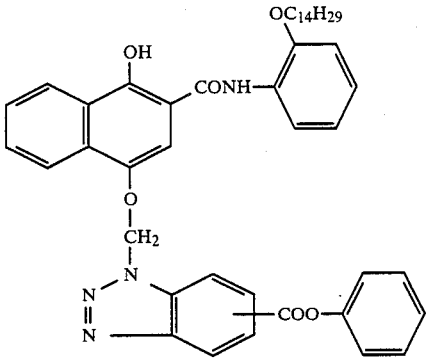
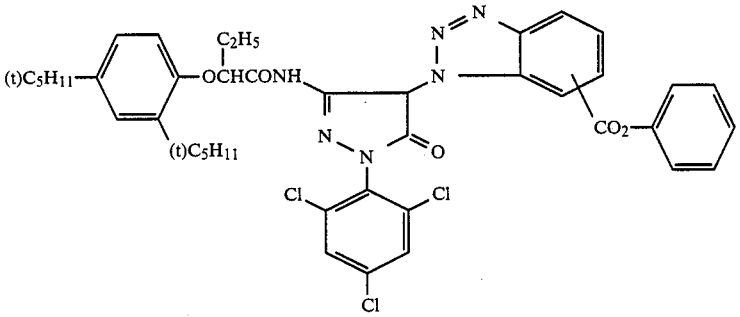
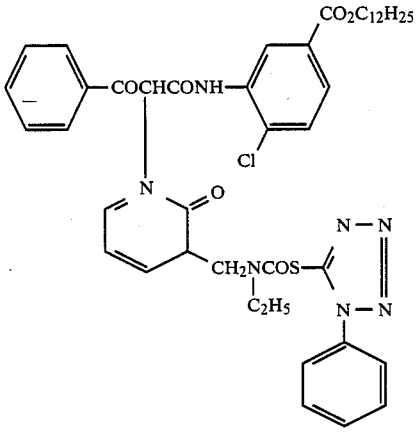
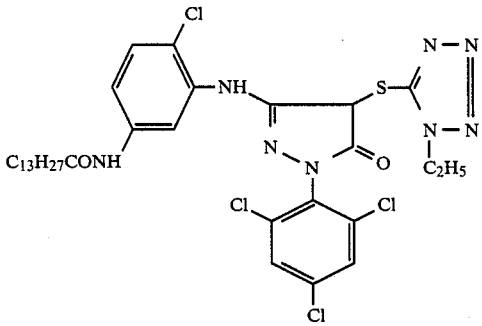

-continued
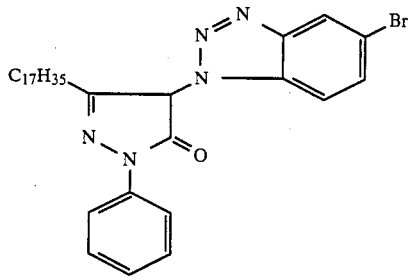
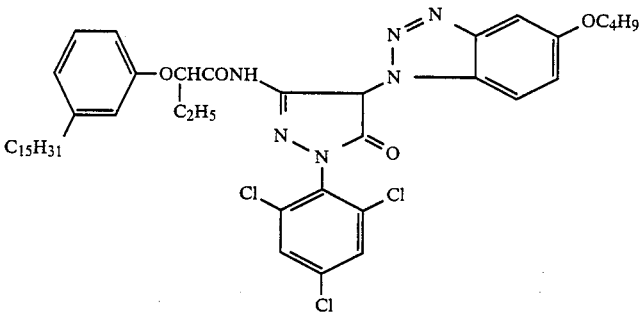
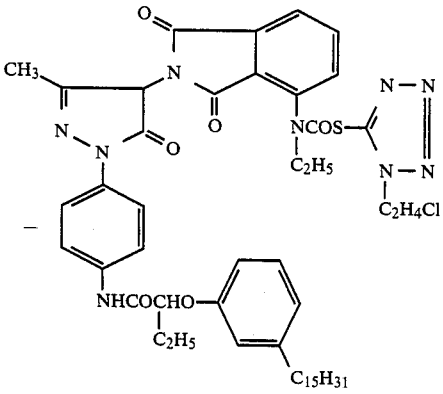
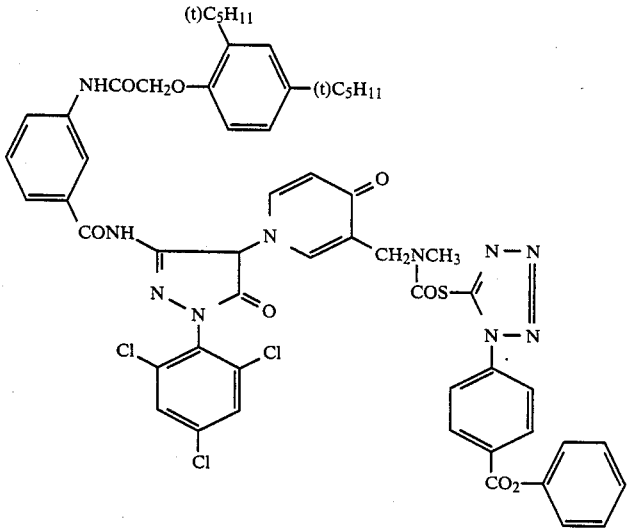

-continued
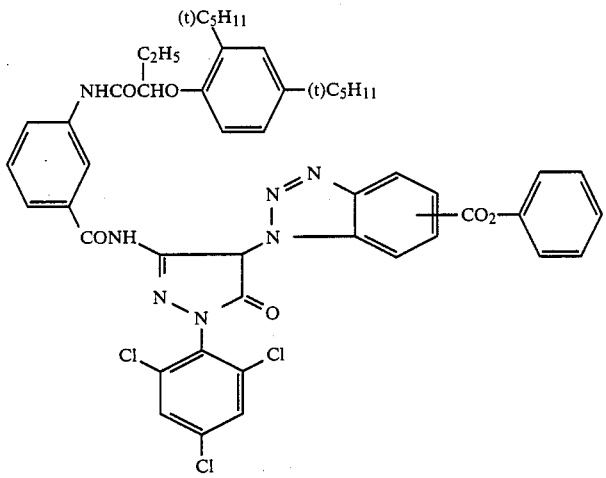
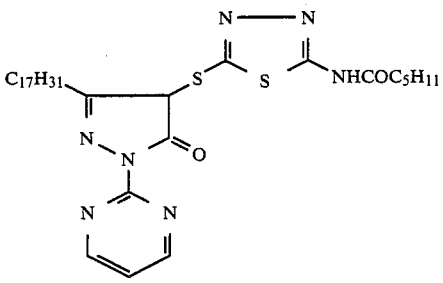
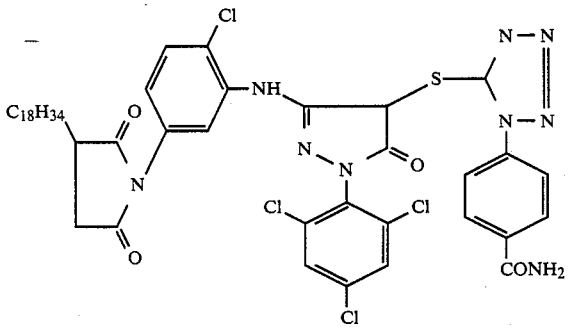
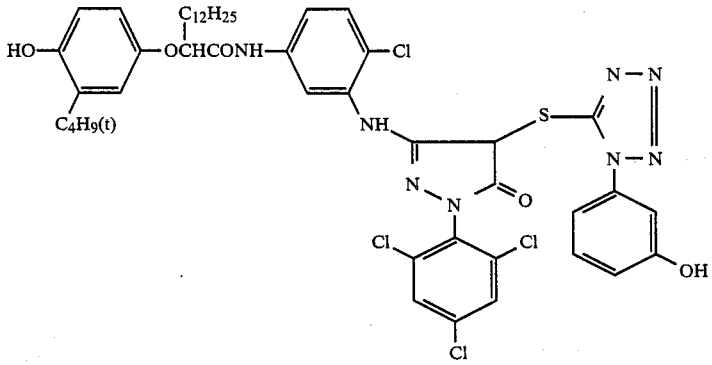

-continued
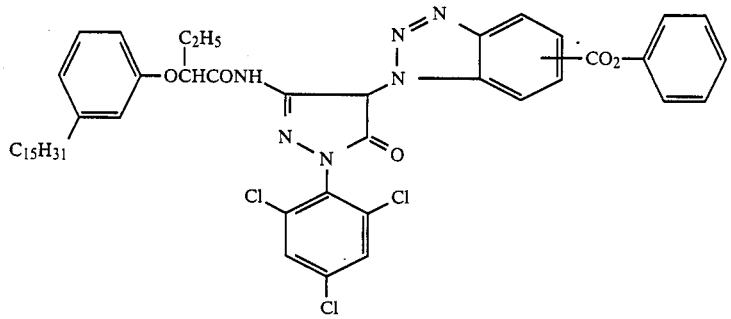
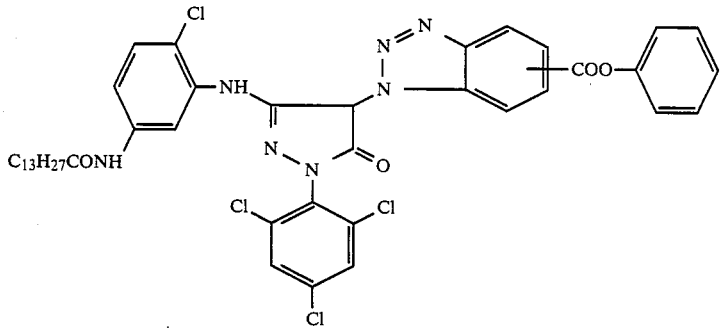
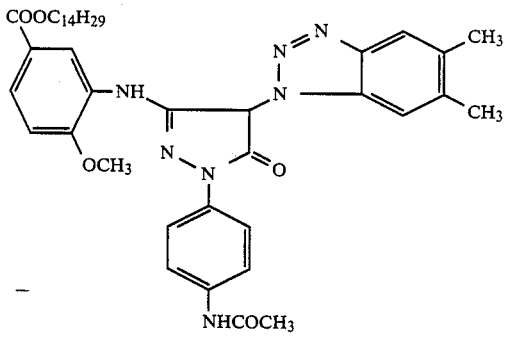
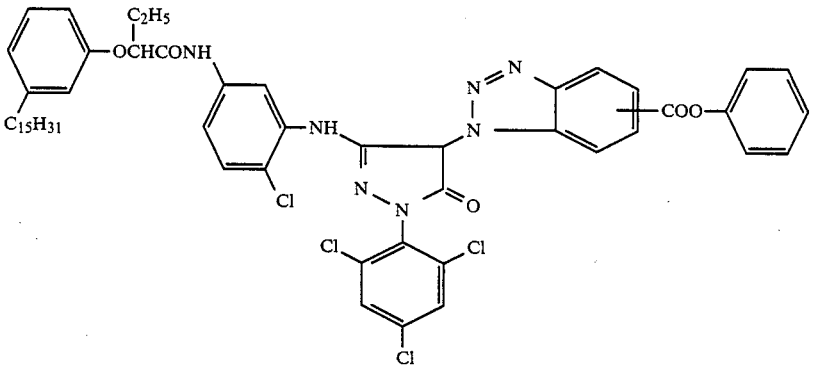
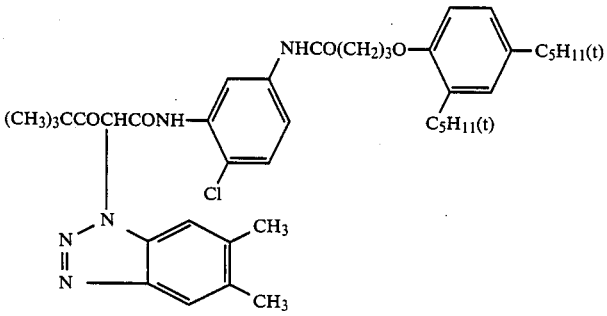

-continued
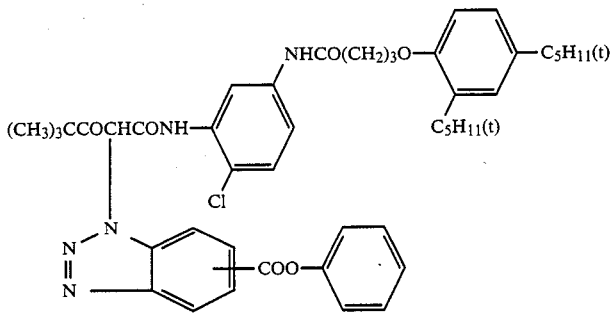
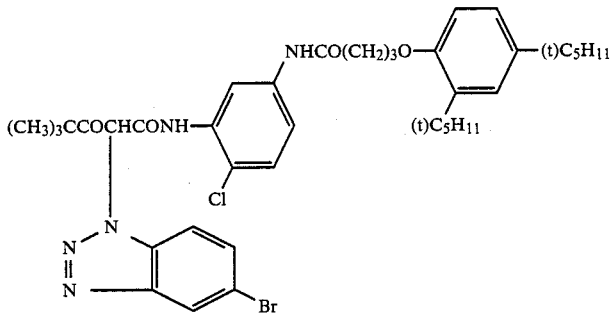
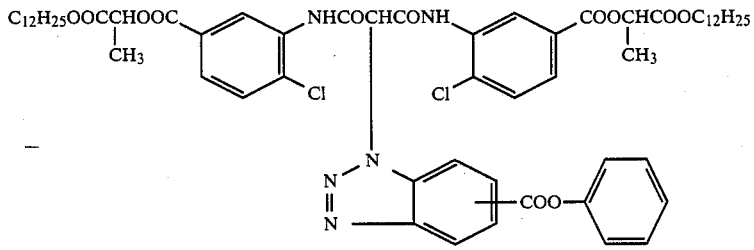
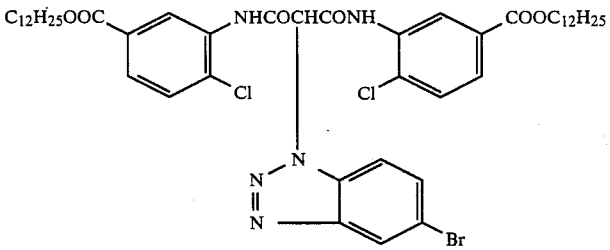
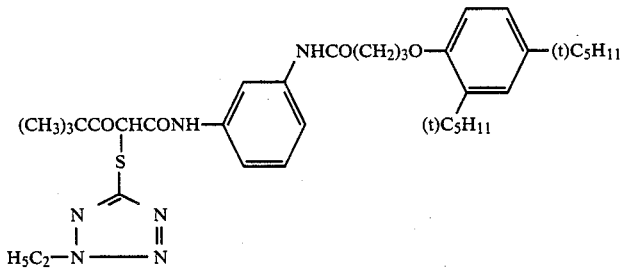

-continued
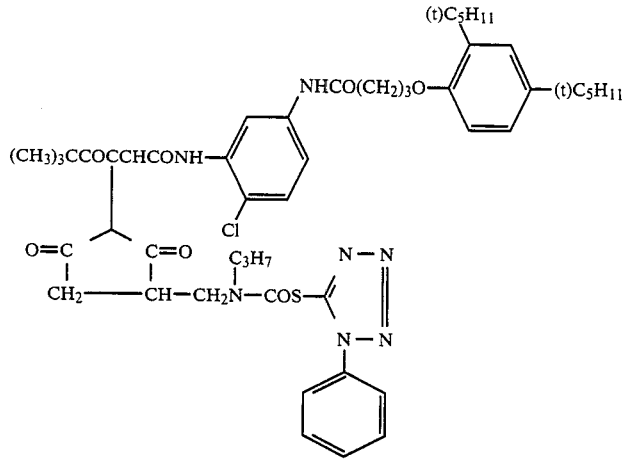
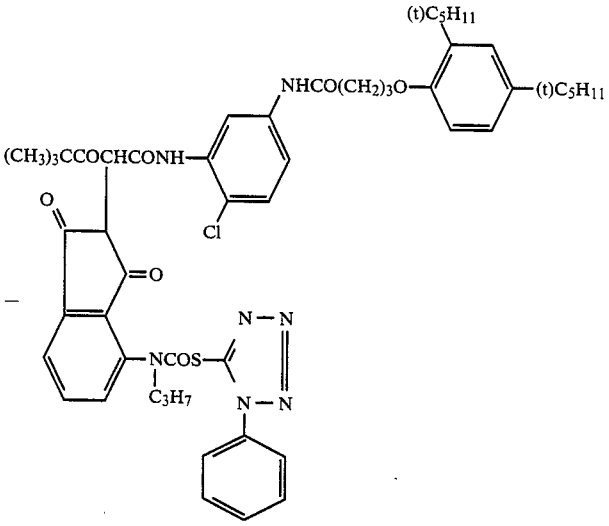
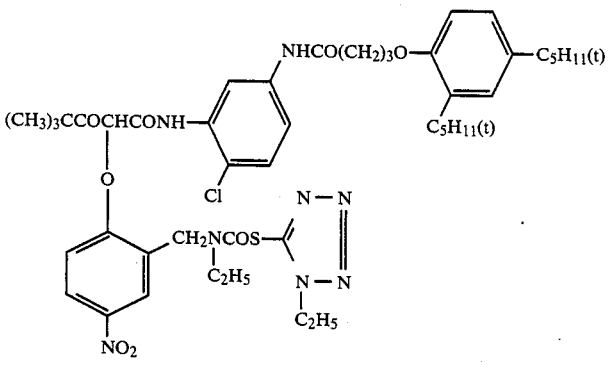

-continued
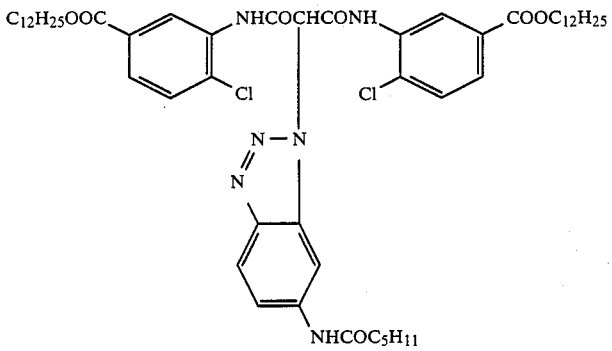
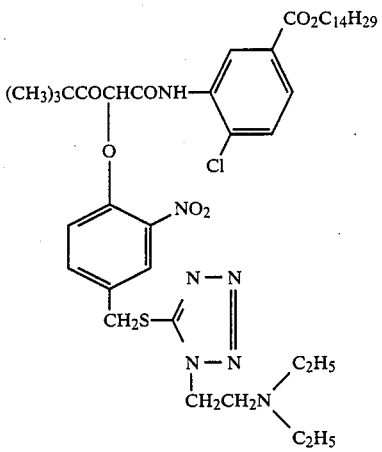
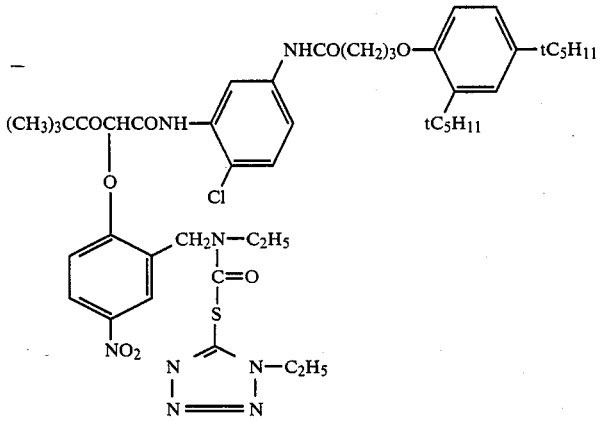
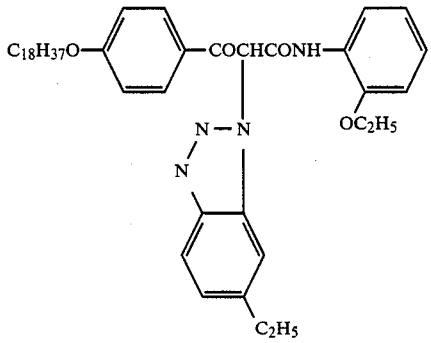

-continued
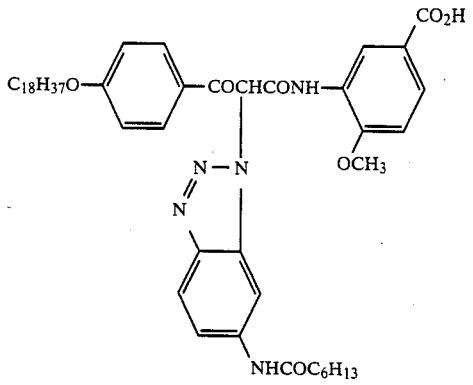
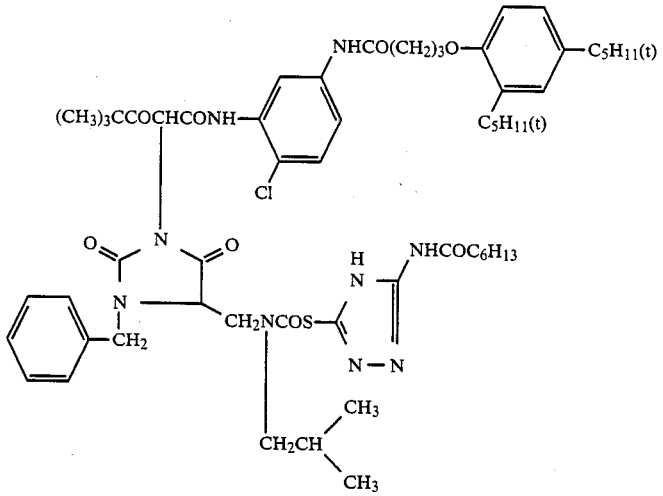
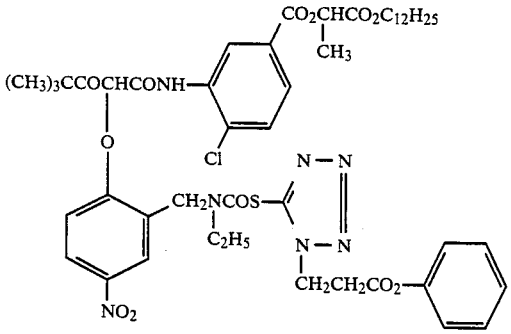
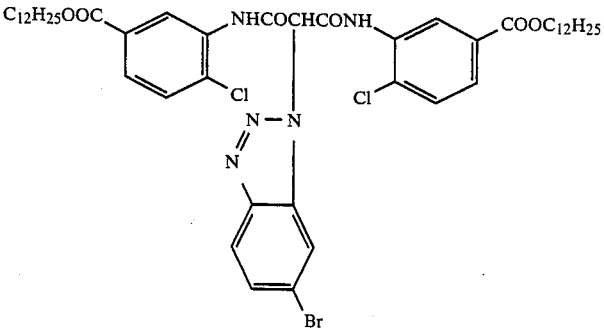

-continued

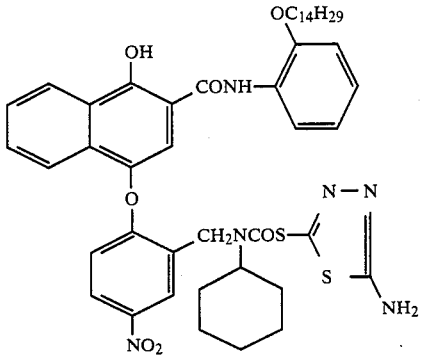

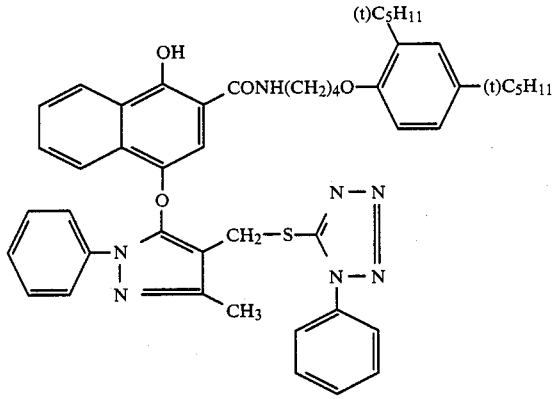

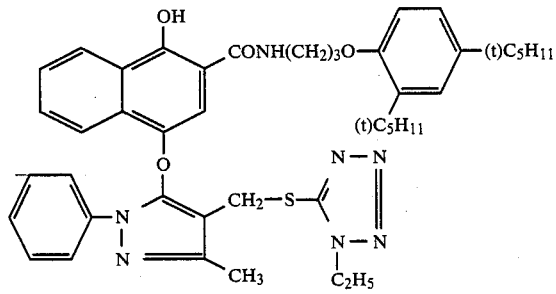

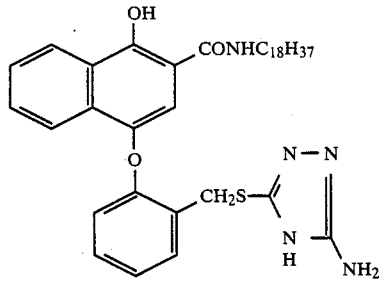

The black coupling partial layer preferably does not contain DIR coupler. Of all the light sensitive layers producing an optical density on colour development this partial layer is the one furthest away from the layer support in the whole combination of layers, although it may be covered by one or more protective layers and or auxillary layers which may contain micrat emulsions of very low sensitivity.

The black coupling layer and first colour coupling layer are preferably separated by a light insensitive separating layer containing a white coupler and/or a formaldehyd acceptor.

The maximum density of the black coupling partial layer should in particular be in the range of from 0.1 to 1.0 preferably from 0.2 to 0.6.

The black partial image may be obtained by a mixture of yellow, magenta and cyan coupler or by means of black couplers (described e.g. in DE-OS No. 2 818 363) or by other coupler mixtures.

In one particular embodiment, a highly sensitive solarising emulsion is used in the panchromatically sensitive, black coupling layer. The black density portion of the pan-sensitive layer is thereby restricted to the region of low densities in the negative (i.e. the region of high densities in the positive copy).

As to how a photographic emulsion must be constituted so that it will solarise, i.e. so that its characteristic curve (optical density as a function of exposure) will pass through a maximum in negative development, this has been described, for example, in H. Frieser, Die Grundlagen der fotografischen prozesse mit Silberhalogeniden, Akademische Verlagsgesellschaft, Frankfurt am Main, 1968, page 1217 et seq.:

The silver halide grains of the emulsion must have a diameter of at least 0.5$\mu$ and consist of mixed crystals of various halides, e.g. Ag (Br, I), Ag(Br, Cl), or Ag(Br, I, Cl) so that a portion of the latent image nuclei may also develop in the interior of the grain on exposure. Slight chemical ripening (preferably with gold compounds) during precipitation is advantageous for this purpose (in addition to chemical ripening on the surface of the grain). Relatively high precipitation and ripening temperatures (50° to 60° $\epsilon$), the presence of small quantities of $NH_3$ during precipitation, $P_H$ values $\leqq 6$ and the presence of a Br-excess during casting are also advantageous for achieving solarisation. Halogen acceptors such as sulphite, ascorbic acid, nitrite or hydrazides or others should not be present to any great extent during exposure as halogen acceptors render solarisation more difficult.

The colour producing layers contain, in the usual manner, the colour couplers which are complementary to the main spectral sensitivities, in other words the red sensitive layer contains cyan couplers, the green sensitive layer magenta couplers, and the blue sensitive layer yellow couplers.

For the production of the light sensitive colour photographic recording material, the couplers may be incorporated in known manner in the casting solution of the silver halide emulsion layers or other colloid layers. For example, the oil soluble or hydrophobic couplers may be added to a hydrophilic colloid solution from a solution in a suitable coupler solvent (oil former), optionally in the presence of a wetting or dispersing agent. The hydrophilic casting solution may, of course, contain other conventional additives in addition to the binder. The solution of the coupler need not be directly dispersed in the casting solution for the silver halide emulsion layer or another water-permeable layer but may advantageously first be dispersed in an aqueous, light-insensitive solution of a hydrophilic colloid, and the resulting mixture may then be mixed with the casting solution for the light sensitive silver halide emulsion layer or some other water-permeable layer before it is applied optionally after removal of the low boiling organic solvent used. So called latex couplers, for example, are suitable.

The light sensitive silver halide emulsions may suitably be emulsions of silver chloride, silver bromide or mixtures thereof, optionally with a small silver iodide content of up to 10 mol %, in one of the commonly used hydrophilic binders. The binder used for the photographic layers is preferably gelatine but this may be partly or completely replaced by other natural or synthetic binders.

The silver halide grains may the usual crystallographic planes (100, 111, 110 etc.), they may be homodispers, heterodispers, twinned or not twinned, shell-structured, e.g. of "core-shell"-type, "double-structured", "T-grains" or other grain types and/or mixtures of different grain-types.

The emulsions may be chemically sensitized in the usual manner and both the emulsion layers and other, light insensitive layers may be hardened with known hardeners in the usual manner.

Each of the above mentioned light sensitive layers may consist of a single layer or it may be composed of two or more silverhalide emulsion partial layers in known manner, e.g. as in so-called double layer arrangements (DE-C-1 121 470). Red sensitive silverhalide emulsion layers are normally arranged closer to the layer support than green sensitive silverhalide emulsion layers which in turn are arranged closer than the blue sensitive layers, and a light sensitive yellow filter layer is generally placed between the green sensitive layers and the blue sensitive layers, although other arrangements could conceivably be used. A light insensitive intermediate layer is generally arranged between layers differing in their spectral sensitivity, and this intermediate layer may contain means for preventing accidental diffusion of developer oxidation products. When several silverhalide emulsion layers of the same spectral sensitivity are present, these may be arranged adjacent to one another or they may be separated by a light sensitive layer having a different spectral sensitivity (See e.g. DE-A Nos. 1 958 709, 2 530 645, and 2 622 922).

The colour couplers may be either conventional 4-equivalent couplers or 2-equivalent couplers which require a smaller quantity of silverhalide for colour production.

2-equivalent couplers are derived, as is known, from 4-equivalent couplers in that they contain, in the coupling position, a substituent which is split off in the coupling reaction. 2-equivalent couplers include both couplers which are virtually colourless and couplers with an intense colour of their own which disappears in the process of colour coupling to be replaced by the colour of the image dye produced. The last mentioned couplers may be present additionally in the light sensitive silverhalide emulsion layers. For the material of the invention it is of advantage to use masking couplers in amounts somewhat higher than necessary compensating the secondary densities of the image dyes, because at higher masking-effects there results generally also a higher IIE. Also to be included among the 2-equivalent couplers are the known white couplers which do not produce a dye as a result of a reaction with colour developer oxidation products. The known, e.g. above described DIR couplers in which the coupling position carries a removeable group which is released as diffusible development inhibitor as a result of a reaction with colour developer oxidation products are also 2-equivalent couplers. Such couplers may also release other photographically active compounds in the process of development, e.g. development accelerators or foggants.

Couplers which release development accelerators or foggants in the process of colour development (known in the literature as DAR or FAR Couplers) are particularly advantageous if they are added only to the panchromatically sensitized layer in order to increase the sensitivity.

The colour photographic recording material of the present invention may contain other additives in addition to the components mentioned above, e.g. anti-oxydants, dye stabilizers and agents for influencing the mechanical and electrostatic properites. It is advantageous to use UV-absorbent compounds in one or more of the layers of the recording material, preferably in one of the upper layers, in order to prevent or reduce the adverse effects of UV-light on colour images produced with the colour photographic recording material according to the invention. Suitable UV absorbents are described, for example, in U.S. Pat. No. 3,253,921, DE-C No. 2 036 719 and EP-A No. 0 057 160. Suitable protective agents such as formaldehyde acceptors or scavengers such as white couplers or hydroquinone derivatives may be added for protection against formaldehyde and other harmful gasses.

For the production of colour photographic images, the colour photographic recording material according to the invention is developed with a colour developer compound. Any developer compound whose oxydation product is capable of reacting with colour couplers to form azomethine dyes may be used. Suitable colour developer compounds include aromatic compounds of the p-phenylendiamine series containing at least one primary amino group, e.g. N,N-Dialkyl-p-phenylene diamines such as N,N-Diethyl-p-phenylene diamine, 1-(N-ethyl-N-methyl-sulphonamidoethyl)-3-methyl-p-phenylene diamine, 1-(N-ethyl-N-hydroxyethyl)-3-methyl-p-phenylene diamine and 1-(N-ethyl-N-methoxyethyl)-3-methyl-p-phenylene diamine.

EXAMPLE 1

Layer arrangement 1A (comparison arrangement; no DIR couplers, low IIE).

The following layers were applied, in the sequence given, to a transparent layer support of cellulose triacetate.

The quantities refer in each case to 1 $m^2$. The quantities of silverhalide applied are given in terms of the corresponding quantities of $AgNO_3$.

All the silverhalide emulsions were stabilized with 0.1 g of 4-Hydroxy-6-methyl-1,3,3a,7-tetra-azaindene per 100 g of $AgNO_3$.

1st Layer (anti-halation layer)

0.2 g of black colloidal silver,
1.2 g of gelatine,
0.1 g of UV absorbent corresponding to the formula

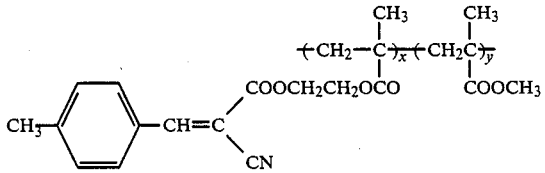

Ratio by weight x:y=7:3
0.2 g of UV-absorbent corresponding to the formula

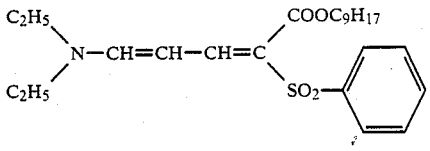

0.02 g of tricresyl phosphate
0.03 g of dibutyl phthalate

2nd Layer (micrat intermediate layer)

0.25 g of $AgNO_3$ of micrat-Ag(Br. I) emulsion: mean grain diameter 0.07 μm; 0.5 mol% iodide
1.0 g of gelatine,
0.05 g of red mask corresponding to the formula

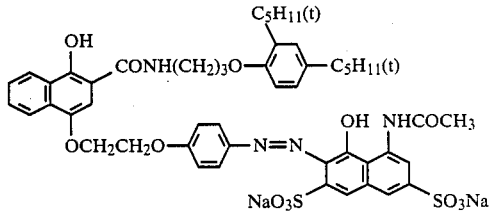

0.10 g of tricresyl phosphate

3rd Layer (low sensitivity red sensitive layer)

1.3 g $AgNO_3$ of spectrally red sensitized AG(Br, I) emulsion, mean grain diameter 0.3 μm,
3 Mol% Iodide.
1.5 g of gelatine,
0.5 g of cyan coupler corresponding to the formula

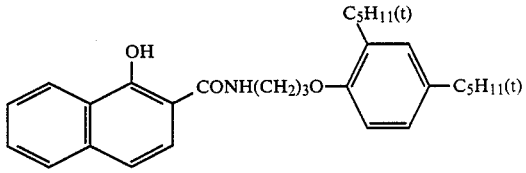

0.09 g of the red mask of the second layer,
0.12 g of tricresyl phosphate
0.12 g of dibutyl phthalate

4th Layer (separating Layer)

0.8 g of gelatine
0.05 g of 2,5-di-t-pentadecylhydroquinone
0.05 g of tricresyl phosphate
0.05 g of dibutyl phthalate

5th Layer (low sensitivity green sensitive layer)

1.0 g $AgNO_3$ of a spectrally green sensitized Ag(Br, I) emulsion, mean grain diameter 0.3 μm, 4.5 Mol% iodide.
1.1 g of gelatine
0.4 g of magenta coupler corresponding to the formula

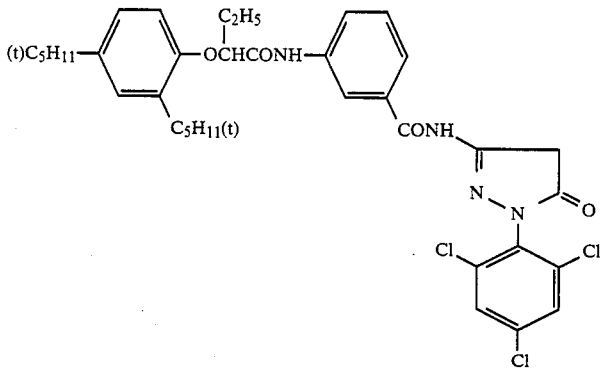

0.15 g of yellow mask corresponding to the formula

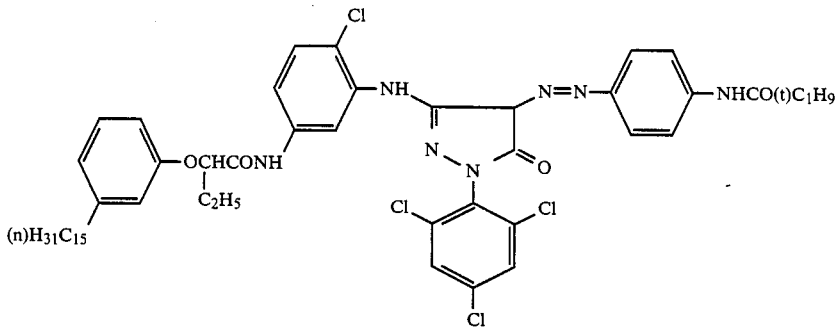

0.6 g of tricresyl phosphate

6th Layer (yellow filter layer)

0.03 g of yellow colloidal silver, passivated with 8 mg of 1-phenyl-5-mercaptotetrazole/g of Ag
0.8 g of gelatine
0.15 g of 2,5-di-t-pentadecyl hydroquinone
0.2 g of tricresyl phosphate 7th Layer (low sensitivity blue sensitive layer)

0.60 g $AgNO_3$ of a spectrally blue sensitized Ag(Br, I) emulsion, mean grain diameter 0.3 μm, 4.5 Mol% AgI
1.0 g of gelatine
0.85 g of yellow coupler corresponding to the formula

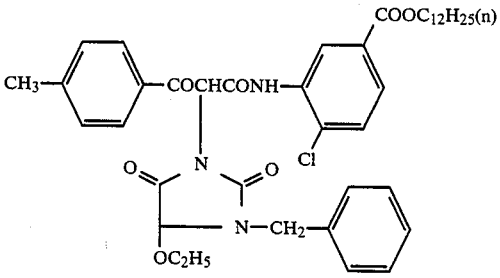

8th Layer (separating Layer)

Same as 4th layer.

9th Layer (highly red sensitive layer)

1.7 g $AgNO_3$ of a spectrally red sensitized Ag(Br, I) emulsion, mean grain diameter 0.7 μm, 6 mol% iodide
1.2 g of gelatine
0.07 g of cyan coupler corresponding to the formula

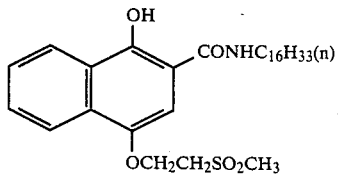

0.02 g of red mask as in 2nd layer
0.01 g of tricresyl phosphate
0.05 g of dibutyl phthalate 10th Layer (separating Layer)

Same as 4th layer.

11th Layer (highly green sensitive layer)

1.6 g $AgNO_3$ of a spectrally green sensitized Ag(Br, I) emulsion, mean grain diameter 0.7 μm, 6 mol% iodide.
1.1 g of gelatine
0.08 g of the magenta coupler of the 6th layer,
0.02 g of the yellow mask of the 6th layer
0.15 g of tricresyl phosphate 12th Layer (yellow filter layer)

Same as the 6th layer

13th Layer (highly blue sensitive layer)

0.95 g $AgNO_3$ of spectrally blue sensitized Ag(Br, I) emulsion, mean grain diameter 1.4 μm, 9.5 Mol% of iodide.
0.7 g of gelatine
0.25 g of the yellow coupler used in 9th layer
0.1 g of tricresyl phosphate 14th Layer (separating layer)

0.6 g of gelatine
0.06 g of 2,5-di-tert-pentadecyl hydroquinone
0.06 g of tricresyl phosphate
0.08 g of dibutyl phthalate
0.24 g of UV-absorbent mixture used in 1st layer.

15th Layer (panchromatically black coupling, highly sensitive layer)

0.5 g $AgNO_3$ of a spectrally red and green sensitized Ag(Br, I) emulsion, mean grain diameter 1.4 μm 9 Mol% iodide.
1.0 g of gelatine
0.09 g of cyan coupler as in the 4th layer
0.11 g of magenta coupler as in the 6th layer
0.10 g of yellow coupler as in the 9th layer
0.30 g of tricresyl phosphate
The maximum density of this layer is 0.42

16th Layer 0.5 g $AgNO_3$ of micrat-Ag(Br, I) emulsion, mean grain diameter 0.07 μm, 0.5 Mol% of iodide.
1.2 g of gelatine
0.4 g of hardener of the formula $(CH_2{=}CH{-}SO_2{-}CH_2{-}CONH{-}CH_2)_2{-}$
1.0 g of formaldehyde acceptor corresponding to the formula

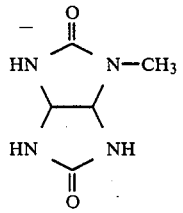

0.25 g of polymethacrylate particles, mean grain diameter 1.5 μm.
Compared with the emulsion of the 15th layer, the emulsions of the 9th, 11th and 13th layers had a lower sensitivity by 3.2 DIN, 4.2 DIN and 4.8 DIN, in that order.

Layer Arrangement 1B (according to the invention)

Same as layer arrangement 1A, but with the following modifications:

In the 3rd layer (low sensitivity red sensitive layer)

2.5 g $AgNO_3$
and in addition 0.02 g of DIR Coupler corresponding to the formula.

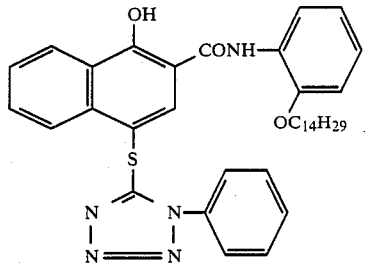

emulsified in 0.02 g of tricresyl phosphate

In the 5th layer (low sensitivity green sensitive layer)

1.6 g $AgNO_3$
and in addition 0.06 g of DIR Coupler corresponding to the formula

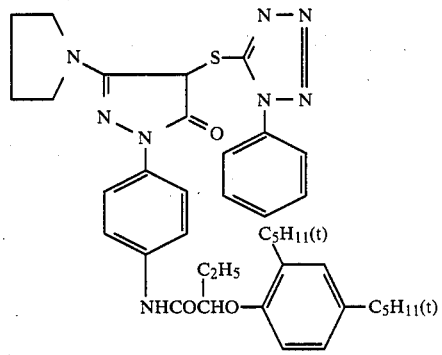

emulsified in 0.06 g of dibutyl phthalate

In the 7th Layer (low sensitiviy blue sensitive layer)

0.9 g $AgNO_3$
and in addition 0.08 g of DIR-Coupler corresponding to the formula

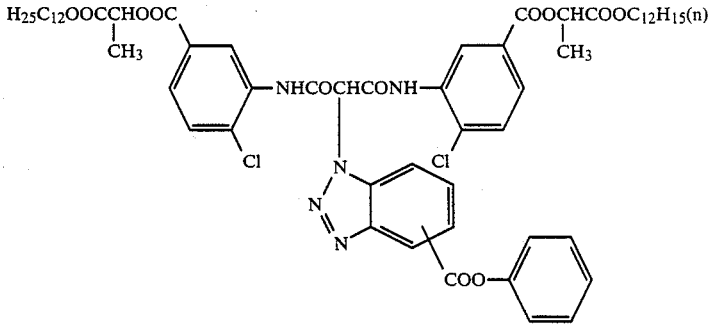

In the 9th Layer (highly red sensitive layer)

2.5 g $AgNO_3$ and in addition 0.05 g of DIR coupler corresponding to the formula

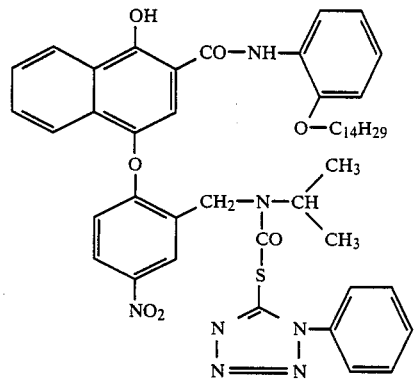

In the 10th Layer (separating layer)

In addition 0.05 g of DIR coupler corresponding to the formula

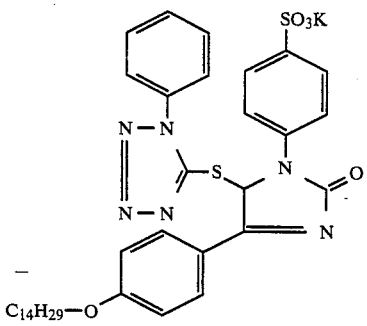

In the 11th layer (highly green sensitive layer)

2.4 g $AgNO_3$ 0.028 g of yellow mask and in addition 0.06 g of the DIR coupler of the 10th layer.

In the 12th layer (yellow filter layer)

In addition 0.08 g of the DIR coupler of the 10th layer

13th layer (highly blue sensitive layer)

1.5 g $AgNO_3$ and in addition 0.10 g of the DIR coupler of the 10th layer.

The emulsions of the 9th, 11th and 13th layer showed the same sensitivity differences to the 15th layer as in 1A.

One sample of each of the variations 1A and 1B was exposed behind a grey step wedge to white light, another to red, another to green and another to blue light and then subjected to a colour negative process as described in th British Journal of Photography, (1974) pages 597 and 598. The resulting IEE values are entered in Table 1.

TABLE 1

| IIE | Variation 1A | Variation 1B |
|---|---|---|
| Yellow | 5% | 15% |
| Magenta | 8% | 35% |
| Cyan | 10% | 30% |

Table 2

The photographic sensitivity in DIN of the two variations 1A and 1B (exposure to white light, measurement of colour density curves with coloured light behind separation filters) are entered in Table 2:

TABLE 2

| Measuring Light | Variation 1A | Variation 1B |
|---|---|---|
| Blue | 28.3 | 28.2 |
| Green | 28.5 | 28.4 |
| Red | 28.1 | 28.1 |

EXAMPLE 2

Figure 1:
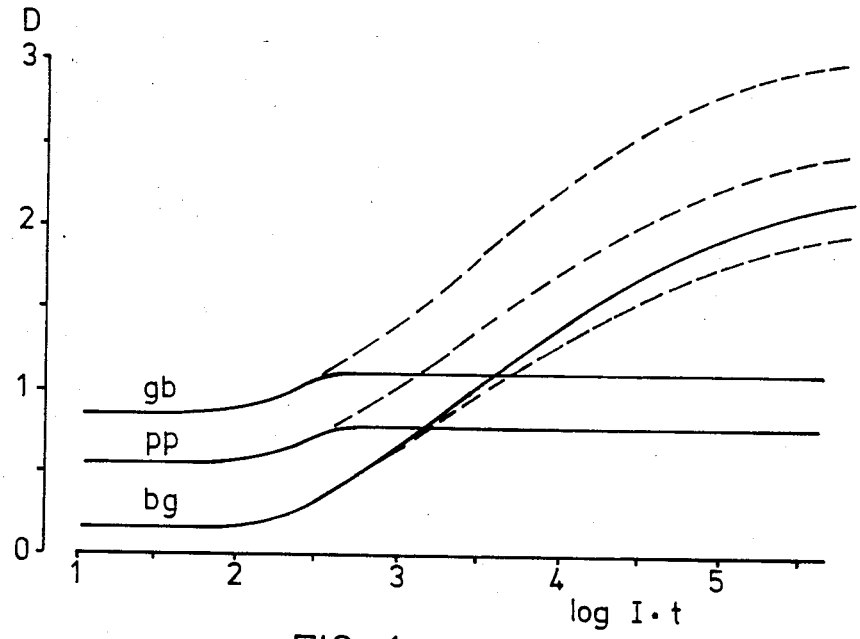
FIG. 1 shows how in variation 1A the colour saturation in the negative is reduced by the black component of the panchromatic partial layer (blackening of the negative colour, e.g. cyan in the case of exposure to red light) (broken lines: exposure to white light; full lines: exposure to red light).
Figure 2:
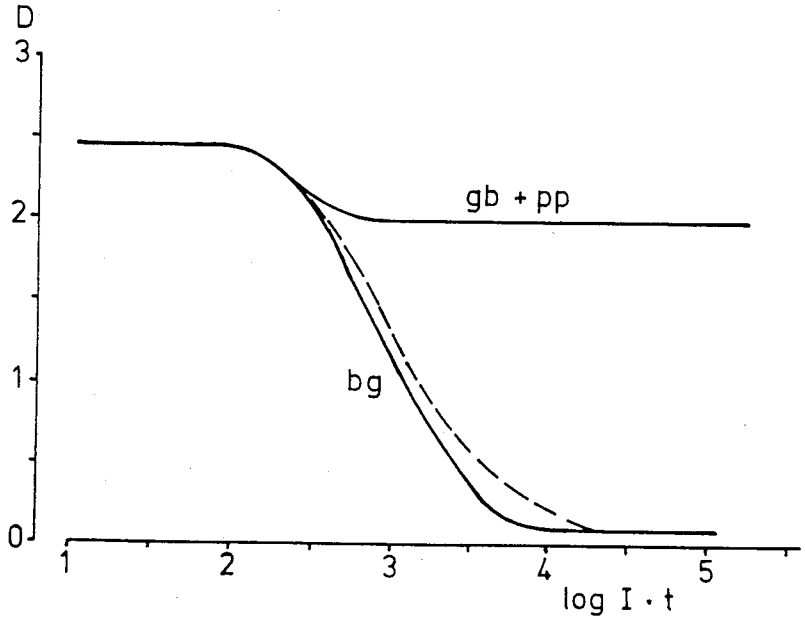
FIG. 2 represents a corresponding positive copy, showing a whitening of the red colour (reduction in yellow and magenta colour density on exposure to red light compared with the original values; broken lines: exposure to white light; full lines; exposure to red light).

Layer Arrangement 2A (arrangement with non-solarising emulsion in the panchromatic layer)

A colour negative material was prepared by applying the following layers in the given sequence to a transparent layer support of cellulose triacetate. The quantities are based in each case on 1 $m^2$. The quantities of silverhalide applied are given in terms of the corresponding quantities of $AgNO_3$. The silverhalide emulsions used were silver iodobromide emulsions which had been stabilised with 0.5 g 4-hydroxy-6-methyl-1,3,3a,7-tetraazaindene per 100 g of $AgNO_3$.

First Layer: (antihalation layer), 0.33 g of Ag (black colloidal silversol), 1.5 g of gelatine.

Second Layer: (interlayer), 0.6 g of gelatine.

Third Layer: (low sensitivity red sensitized layer), 2.2 g of $AgNO_3$, 4 mol% iodide, mean grain diameter 0.45 μm, red sensitized, 2.0 g of gelatine, 0.6 g of colourless cyan coupler corresponding to the formula,

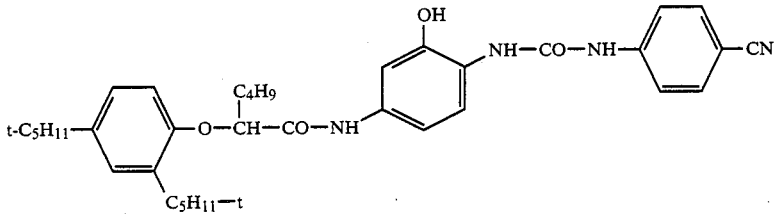

120 mg of coloured cyan coupler corresponding to the formula

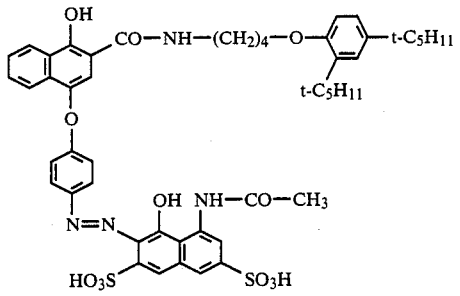

20 mg of DIR coupler according to example 1B, third layer, emulsified with 10 mg of tricresyl phosphate
10 mg of DIR coupler corresponding to the formula

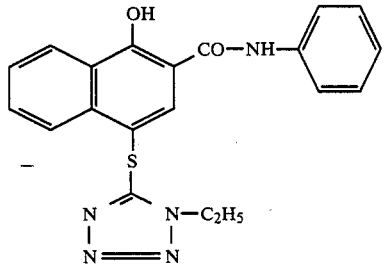

emulsified with 5 mg of tricresyl phosphate
4th Layer: (highly red sensitized layer) 2.8 g of $AgNO_3$, 8.5 Mol% iodide, mean grain diameter 0.8 μm, red sensitized, 1.8 g of gelatine, 0.15 g of colourless cyan coupler corresponding to the formula,

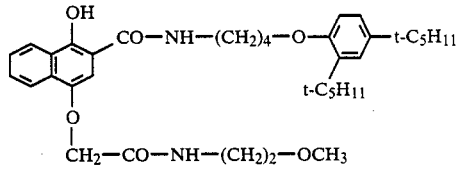

emulsified with 0.15 g of dibutylphthalate 0.03 g of cyan masking coupler as in the 3rd layer
5th Layer: (separating layer) 0.7 g of gelatine, 0.2 g of 2,5-diisooctyl hydroquinone emulsified with 0.15 g of dibutylphthalate.
6th layer: (low sensitivity green sensitized layer) 1.8 g $AgNO_3$ of a spectrally green sensitized Ag(Br, I) emulsion containing 4.5 Mol% iodide and having a mean grain diameter of 0.4 μm, green sensitized, 1.6 g of gelatine, 0.6 of magenta coupler corresponding to the formula,

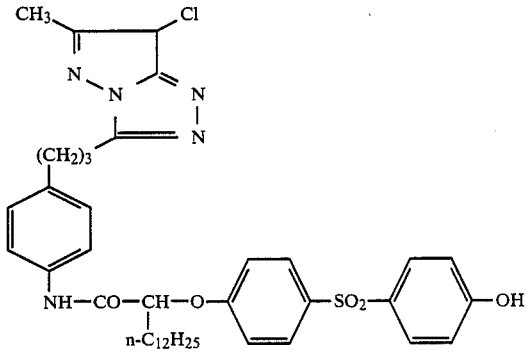

emulsified with 0.6 g of tricresyl phosphate, 50 mg of masking coupler corresponding to the formula

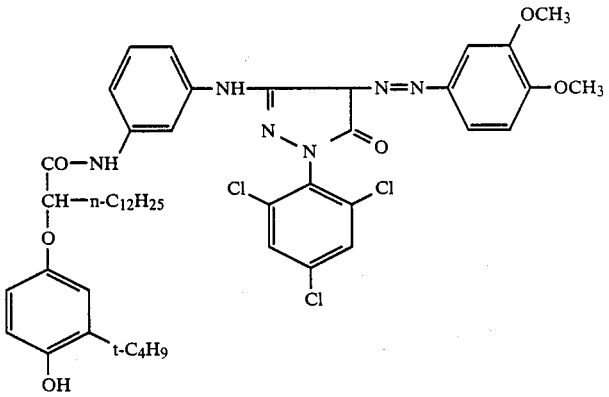

emulsified with 50 mg. of tricresyl phosphate, 30 mg of DIR coupler according to example 1B, 6th layer, emulsified with 30 mg of tricresyl phosphate.

7th Layer: (highly green sensitized layer) 2.2 g $AgNO_3$ with, 7 Mol% iodide, mean grain diameter 0.7 μm, green sensitized, 1.4 g of gelatine, 0.15 g of magenta coupler corresponding to the formula,

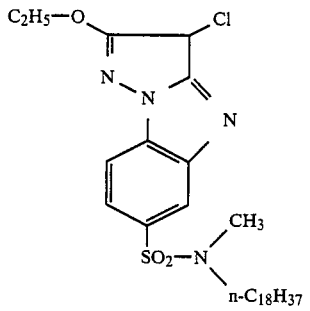

emulsified with 0.45 g of tricresyl phosphate 30 mg of masking coupler corresponding to that of the 6th layer, emulsified with 30 mg of tricresyl phosphate 8th Layer: (separating layer) 0.5 g of gelatine, 0.1 g of 2,5-diisooctyl hydroquinone emulsified with 0.08 g of dibutylphthalate.

9th Layer: (yellow filter layer) 0.2 g Ag (yellow colloidal silversol), 0.9 g of gelatine, 0.2 g of 2,5-diisooctyl hydroquinone emulsified with 0.16 g of dibutylphthalate.

10th Layer: (a low sensitivity blue sensitive layer) 0.6 g $AgNO_3$, 4.9 mol% iodide, mean grain diameter 0.45 μm, blue sensitised, 0.85 g of gelatine, 0.7 g of yellow coupler corresponding to the formula,

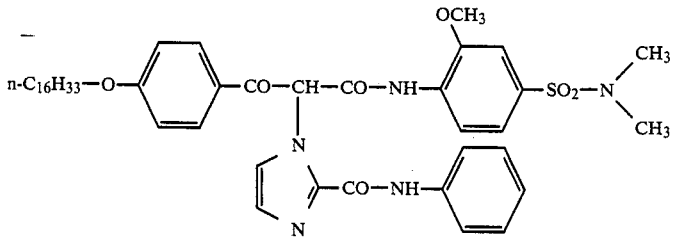

emulsified with 0.7 g of tricresyl phosphate 0.5 g of DIR coupler corresponding to that of example 1B, 7th layer, emulsified with 0.5 g of tricresyl phosphate.

11th Layer: (highly blue sensitive layer) 1.0 g $AgNO_3$, 9.0 mol% iodide, mean grain diameter 0.9 μm, blue sensitized, 0.85 g of gelatine, 0.3 g of yellow coupler corresponding to that of the 10th layer emulsified with 0.3 g of tricresyl phosphate.

12th Layer: (separating layer) Same as 5th layer.

15th Layer: (very highly sensitive, panchromatic, black coupling layer) 0.8 g $AgNO_3$ of a spectrally red and green sensitized, non solarising Ag(Br, I) emulsion which also has an intrinsic blue sensitivity, mean grain diameter 1.2 μm, 5 mol% iodide. 1.0 g of gelatine, 0.23 g of the black coupler N-Methyl-N-octadecyl-m-aminophenol, The maximum density of this layer is 0.36.

14th Layer: (hardening layer), 1.5 g of gelatine and 0.7 of hardener corresponding to the formula,

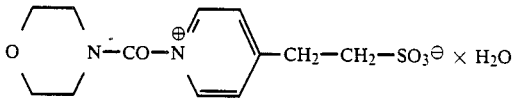

Compared with the emulsion of the 13th layer, the emulsions of the 4th, 7th and 11th layer had a lower sensitivity by 3.0 DIN, 3.8 DIN and 4.6 DIN respectively.

Layer arrangement 2B (arrangement containing solarising emulsion in the panchromatic layer)

Similar to the layer arrangement 2B but containing, as emulsion in the 13th layer, a highly sensitive Ag(Br, I) emulsion, which was solarising and had a mean grain diameter of 1.4 μm and contained 7.5% of iodide: $D_{max}=0.36$ (in the maximum of solarisation)

In addition, in the 4th layer, the $AgNO_3$ content and quantity of gelatine and of colour coupler applied were increased by 80% by weight, and in the 7th layer: $AgNO_3$, gelatine and colour coupler application were increased by 70% by weight, and, in the 11th layer: $AgNO_3$, gelatine and colour coupler application were increased by 65% by weight.

The emulsions of the 4th, 7th and 11th layer differed in their sensitivities from the 13th layer by the same proportions as in 2A. The increases in the amounts applied in the 4th, 7th and 11th layer served to compensate for the colour density loss produced by solarisation.

Exposure and processing as in example 1.

Interimage Effects:

| | Variation 2A | Variation 2B |
|---|---|---|
| Yellow | 10% | 15% |
| Magenta | 20% | 30% |
| Cyan | 15% | 20% |

Sensitivities (exposure to white light, measurement with coloured light behind colour separation filters:

| Measuring Light | Variation 2A | Variation 2B |
|---|---|---|
| Blue | 27.4 DIN | 27.0 DIN |
| Green | 27.4 DIN | 27.4 DIN |
| Red | 27.2 DIN | 27.0 DIN |

Figure 5:
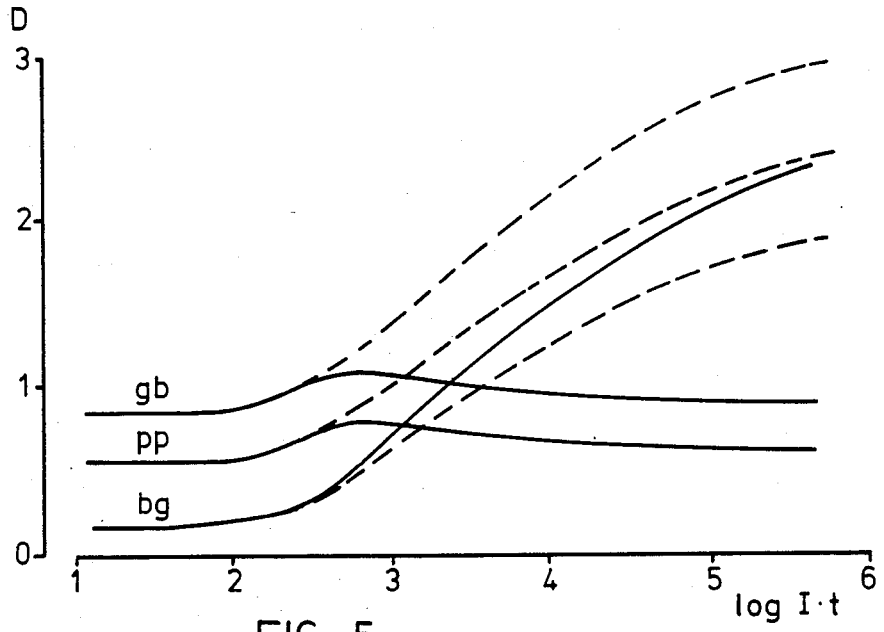

FIG. 5 shows how in variation 2A the colour saturation in the negative is reduced by the black component of the panchromatic partial layer (blackening of the negative colour, e.g. cyan in the case of exposure to red light) (broken lines: exposure to white light; full lines: exposure to red light).

Figure 6:
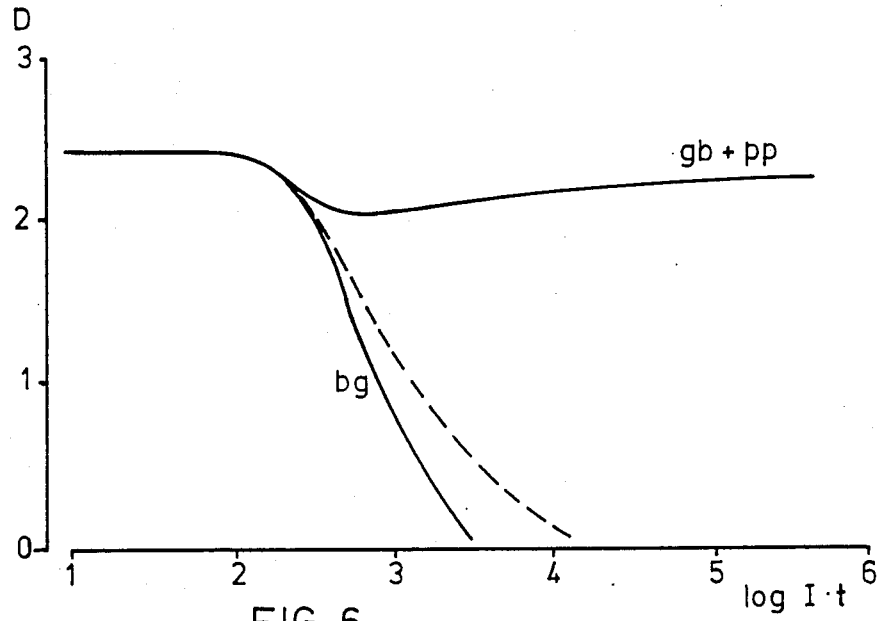

FIG. 6 represents a corresponding positive copy, showing a whitening of the red colour (reduction in yellow and magenta colour density on exposure to red light compared with the original values; broken lines: exposure to white light; full lines: exposure to red light).

Figure 3:
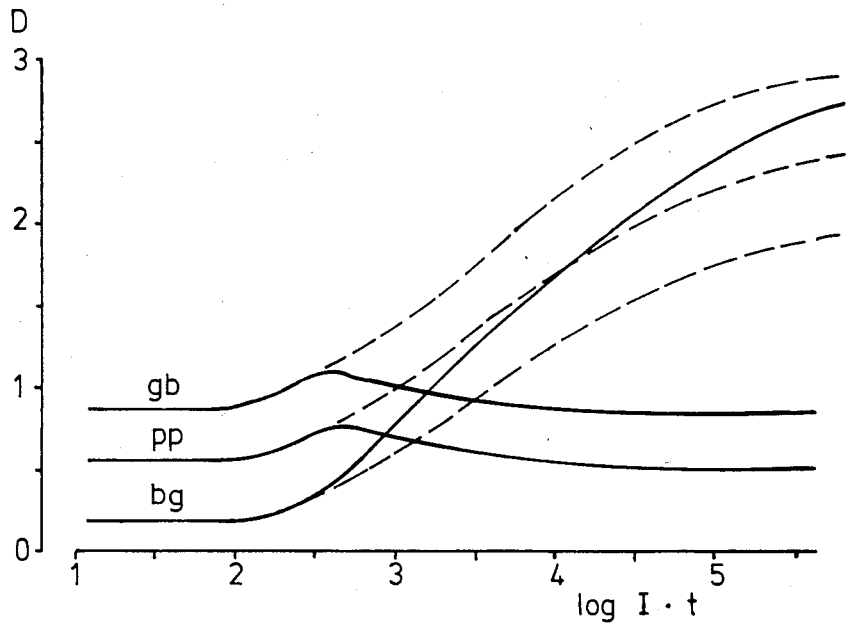
FIGS. 3 and 4 show how this loss is compensated for in variation 1B by the interimage effect.
Figure 4:
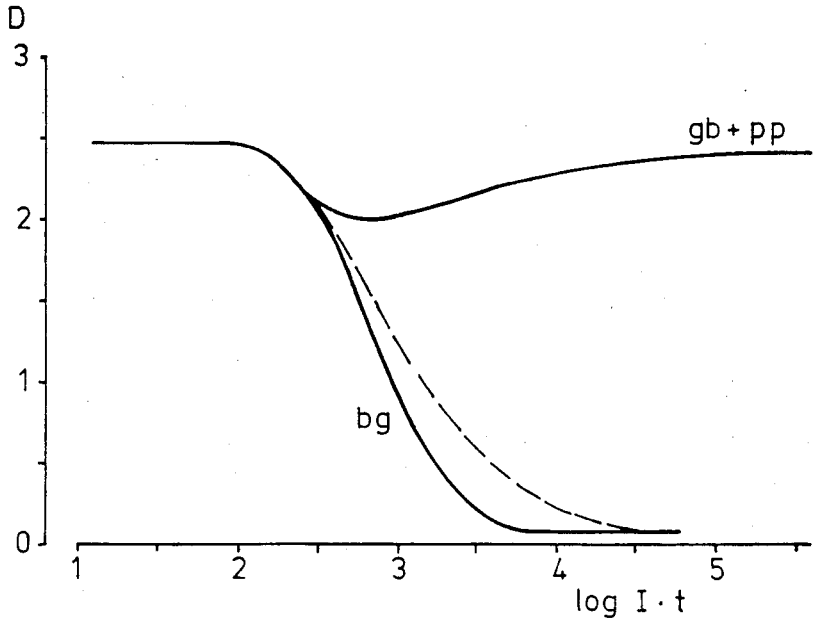
Figure 7:
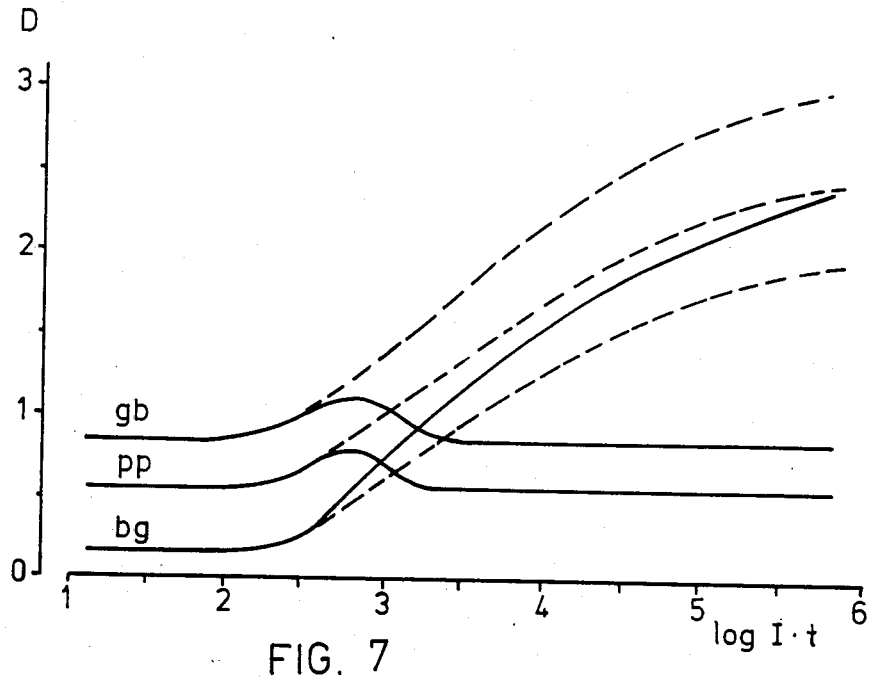
Figure 8:
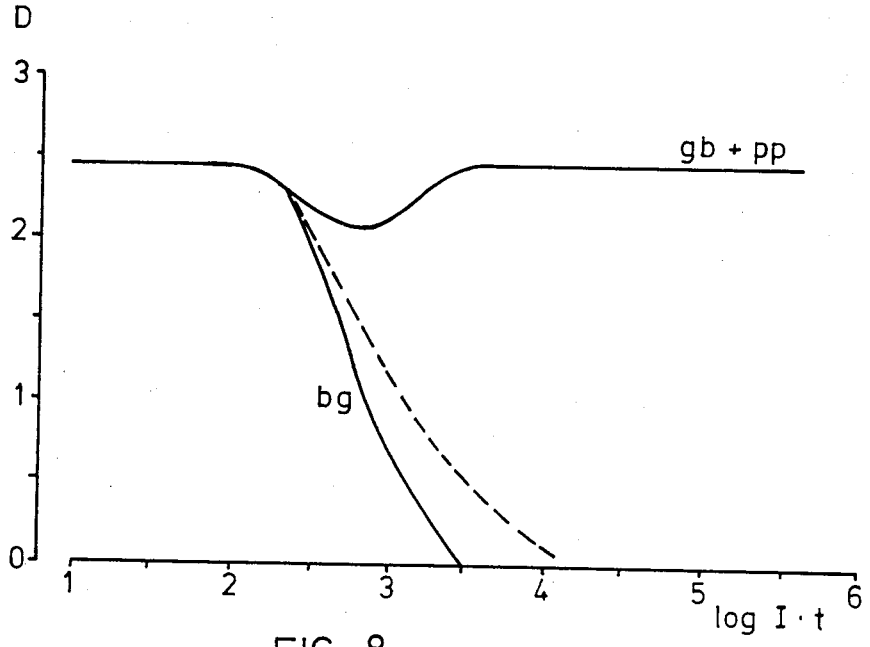

FIGS. 7 and 8 show how this loss is compensated for in variation 2B by the interimage effect;

When FIGS. 7 and 8 are compared with FIGS. 3 and 4, it is seen that increasing the interimage effects and using a solarising emulsion in the black coupling layer results in a further improvement in colour quality in Example 2 compared with Example 1.

I claim:

1. Colour photographic negative film comprising at least one yellow coupling, blue sensitive silverhalide emulsion layer, at least one magenta coupling, green sensitive silverhalide emulsion layer, at least one cyan coupling, red sensitive silver halide emulsion layer and at least one panchromatically sensitized black coupling layer which is arranged as uppermost light sensitive layer and has a sensitivity which is at least 3 DIN higher than the most highly sensitive blue, green, or red sensitive layer, measured in each case as single layer against white light, and other, conventional filter layers, separating layers, protective layers and auxillary layers on a transparent support, characterised in that the negative film contains sufficient DIR coupler to result in interimage effects of ≧10% in the yellow region, ≧25% in the magenta region and ≧15% in the cyan region.

2. Colour photographic negative film according to claim 1 in which each colour coupling multiple layer contains DIR couplers in the low sensitivity layer.

3. Colour photographic negative film according to claim 1, characterised in that the panchromatically sensitized, black coupling layer contains a solarising silver halide emulsion.

4. Colour photographic negative film according to claim 1, characterised in that the maximum density of the black coupling partial layer has a value from 0.1 to 1.0.

5. Colour photographic negative film according to claim 1, characterised in that the DIR coupler corresponds to the formula, $$A-(X)_l-(Y)_m$$

wherein

A denotes a coupler residue

X denotes an intermediate member l has the value 0, 1 or 2 m has the value 1 or 2 and

Y denotes a residue corresponding to one of the following formulae, which can be split off by means of a colour developer oxidation product:

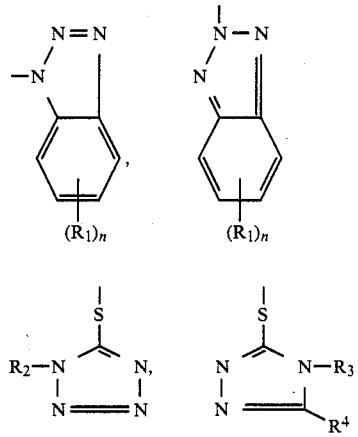

in which formulae, $R_1$ denotes alkyl, alkoxy, acylamino, halogen, alkoxycarbonyl, thiazolidinylideneamino, aryloxycarbonyl, acyloxy, carbamoyl, N-alkylcarbamoyl, N,N-dialkylcarbamoy, nitro, amino, N-arylcarbamoyloxy, sulphamoyl, N-alkylcarbamoyloxy, hydroxy, alkoxycarbonylamino, alkylthio, arylthio, aryl, cyano, alkyl sulphonyl or aryloxycarbonylamino or a heterocyclic group, n has the value of 1 or 2

$R_2$ denotes alkyl, aryl or a heterocyclic group $R_3$ denotes hydrogen, alkyl, aryl or a heterocyclic group and $R_4$ denotes hydrogen, alkyl, aryl, halogen, acylamino, alkoxycarbonylamino, aryloxycarbonylamino, alkylthio or amino or a heterocyclic group.

* * * * *